US007121055B2

(12) United States Patent
Penner

(10) Patent No.: US 7,121,055 B2
(45) Date of Patent: Oct. 17, 2006

(54) RIDGE COVER AND METHOD OF MAKING

(76) Inventor: Lawrence Penner, 3441 S. Willow, Fresno, CA (US) 93725

( * ) Notice: Subject to any disclaimer, the term of this patent is extended or adjusted under 35 U.S.C. 154(b) by 342 days.

(21) Appl. No.: 10/288,202

(22) Filed: Nov. 4, 2002

(65) Prior Publication Data

US 2004/0083672 A1 May 6, 2004

(51) Int. Cl.
*E04D 1/00* (2006.01)
*E04D 1/12* (2006.01)
*E04D 1/28* (2006.01)

(52) U.S. Cl. ..... 52/518; 52/528; 52/57

(58) Field of Classification Search ..... 52/57, 52/526, 528
See application file for complete search history.

(56) References Cited

U.S. PATENT DOCUMENTS

| | | | | |
|---|---|---|---|---|
| 451,550 | A * | 5/1891 | Bayer | 52/528 |
| 2,047,655 | A * | 7/1936 | Von Forster | 228/137 |
| 3,381,426 | A * | 5/1968 | Heidrich | 52/96 |
| 3,848,384 | A * | 11/1974 | Eaton et al. | 52/420 |
| 4,226,069 | A * | 10/1980 | Hinds | 52/521 |
| 4,434,589 | A * | 3/1984 | Freiborg | 52/57 |
| 4,439,955 | A * | 4/1984 | Freiborg | 52/57 |
| 5,065,553 | A * | 11/1991 | Magid | 52/58 |
| 5,094,042 | A * | 3/1992 | Freborg | 52/57 |
| 6,070,384 | A * | 6/2000 | Chich | 52/518 |
| 6,182,400 | B1 * | 2/2001 | Freiborg et al. | 52/57 |
| 6,351,913 | B1 * | 3/2002 | Freiborg et al. | 52/57 |
| 6,574,930 | B1 * | 6/2003 | Kiser | 52/232 |
| 2002/0000068 | A1 * | 1/2002 | Freiborg et al. | 52/57 |
| 2003/0196389 | A1 * | 10/2003 | Naipawer | 52/57 |

* cited by examiner

*Primary Examiner*—Rodney B. White
(74) *Attorney, Agent, or Firm*—Terry L. Miller

(57) ABSTRACT

A shingle ridge cover is formed from a rectangular sheet of shingle roofing material back folded on itself to provide a central thickened portion for the shingle ridge cover. An upper portion of lesser thickness provides a nailing margin for the shingle ridge cover, and cooperates with a centrally-located thickest portion of the shingle ridge cover to provide a safety space to allow for "pop up" of the roofing nails or fasteners. A lower portion of the shingle ridge cover overlies the thickened upper portion of a preceding shingle ridge cover as installed on a roof, and cooperates with the preceding shingle ridge cover so that they together provide three layers of protective shingle sheet material over all portions of a hip, ridge, or rake of a roof on which the shingle ridge covers are installed. The thickened central portion of a ridge cover and the overlying lower portion of a next-successive ridge cover cooperate also to provide a shadow line at a hip, ridge, or rake of a roof, which shadow lines provided by plural shingle ridge covers contributes to an attractive aesthetic appearance for the roof.

13 Claims, 3 Drawing Sheets

RIDGE COVER AND METHOD OF MAKING

BACKGROUND OF THE INVENTION

1. Field of the Invention

Figure 1:
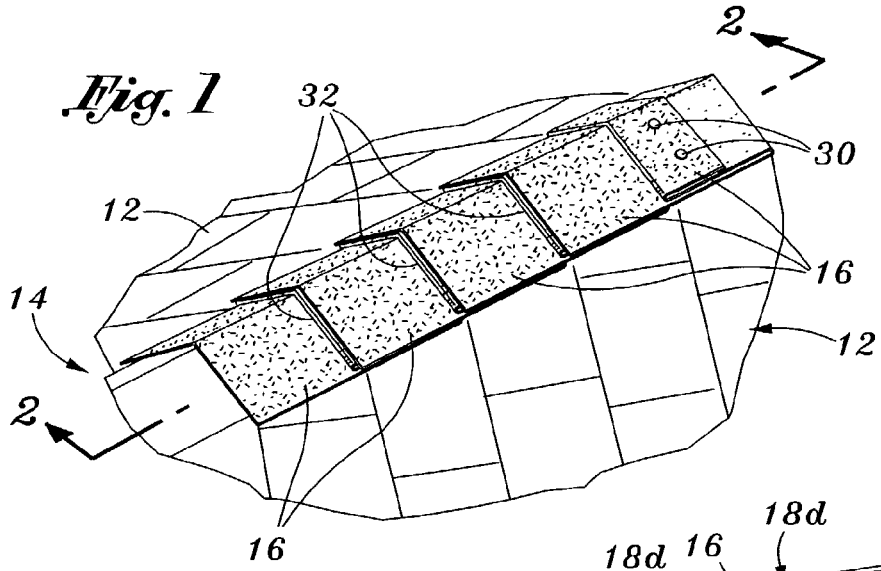

The present invention relates to an aesthetic shingle or ridge cover for roofing. More particularly, the present invention relates to a shingle ridge cover that is particularly efficient to manufacture, is durable, economical to ship, aesthetically pleasing as installed on a roof, and which provides a triple layer of shingle material over the underlying roof structure. As installed, the inventive ridge cover also has a particularly attractive appearance which is somewhat like a comparatively thick wood shake, so that the configuration of the present shingle ridge cover gives an appearance of depth and creates shadow lines at adjacent ridge covers. It is these shadow lines and appearance of depth which are considered among the principal aesthetically pleasing aspects of a wood shake roof. On the other hand, the present shingle ridge cover provides fire protection much better than conventional wood shakes.

2. Related Technology

A conventional low-cost organic asphalt composition ridge cover is known in accord with U.S. Pat. No. 3,913,294, issued 21 Oct. 1975 to B. Freiborg. The Freiborg patent is believed to teach a cover for the hips, ridges, and rakes of a roof wherein the cover includes a body of sheet organic filamentary material or felt layered first on an outer face with saturant asphalt penetrating somewhat through the felt sheet as well as saturating into the filaments of the felt, and then additionally layered with on outer asphalt layer securing a cosmetic and abrasion-resisting outer coating of granular mineral material.

The ridge cover of Freiborg is configured as an elongate trapezoid having a T-shaped slit extending along its length near the center thereof. Plural transverse score lines transect the upright of the T-shaped slit, and the ridge cover is back folded on itself at these score lines either two times or four times to provide a central thickening in the ridge cover. Primarily because the asphalt material tends to be brittle, especially when cool, the ridge cover of Freiborg while warm during manufacturing is folded lengthwise with the granular material outward. This lengthwise fold both to allows shipment of the ridge cover in a compact form, and insures that any bending along the lengthwise fold which occurs in the field preparatory to installation of the cover on a roof is in the direction of unfolding the ridge cover at this lengthwise fold.

SUMMARY OF THE INVENTION

In view of the above, the present invention provides an improved shingle or ridge cover which is particularly configured to provide ease of installation, to provide three layers of shingle material over the underlying roof structure as installed, and to provide an appearance of depth and thickness at adjacent shingle ridge covers on the roof as installed.

The present inventive shingle ridge cover is formed of a base sheet or work piece of fiberglass mat or felt with impregnating asphaltic material modified to make it pliable. The shingle ridge cover is folded at one end, and is back-folded on itself intermediate of its length to provide a thickened portion intermediate of the length of the shingle ridge cover. Adjacent to the one folded end (i.e., adjacent to an "upper" end of the shingle ridge cover), the shingle ridge cover provides a nailing margin that is thinner than the centrally-located thickest portion of the shingle ridge cover.

Consequently, when roofing nails or other fasteners are driven through this nailing margin, the adjacent centrally-located thickest portion of the shingle ridge cover provides protection and,space for the roofing nails or other fasteners used to secure the shingle ridge cover to a roof structure. The centrally-located thickest portion of the shingle ridge cover provides with an adjacent thinner section of the same and in cooperation with an adjacent shingle ridge cover a step or edge at which a shadow line may be created on a roof ridge, rake, or hip having plural shingle ridge covers installed along it. Consequently, as installed, the present inventive ridge cover when installed appears somewhat like a wood shake or like the shingle ridge cover of the old Freiborg patent. However, the improved material from which the present ridge cover is fabricated combined with its triple-layer coverage provided to the underlying roof structure, provides much better protection to the structure, and improved durability for the roof covering.

Additionally, the present improved shingle ridge cover is configured, and shaped so that it is free of slits, cuts, and score lines which had conventionally been employed to facilitate folding of the conventional ridge covers. Accordingly, the present ridge cover offers another increment of improved durability as installed (i.e., because the present shingle ridge cover does not tend to crack, fracture, tear, or fissure at such slits, cuts, or score lines), and also offers improved ease of manufacture.

Further, because of the inventive configuration of this present shingle ridge cover, efficient packing of plural manufactured shingle ridge covers into boxes for shipment to a job site (i.e., where the shingle ridge covers are installed on a roof) is facilitated. That is, the shingle ridge covers are configured to nest together, such as to more efficiently fill a shipping box with very little ullage volume. Accordingly, shipping costs for these shingle ridge covers from their place of manufacture to job sites for installation are reduced.

Additional objects and advantages may be appreciated from a reading of the following detailed description of a single exemplary and preferred embodiment of the invention taken in conjunction with the following drawing Figures, in which:

BRIEF DESCRIPTION OF THE DRAWING FIGURES

Figure 2:
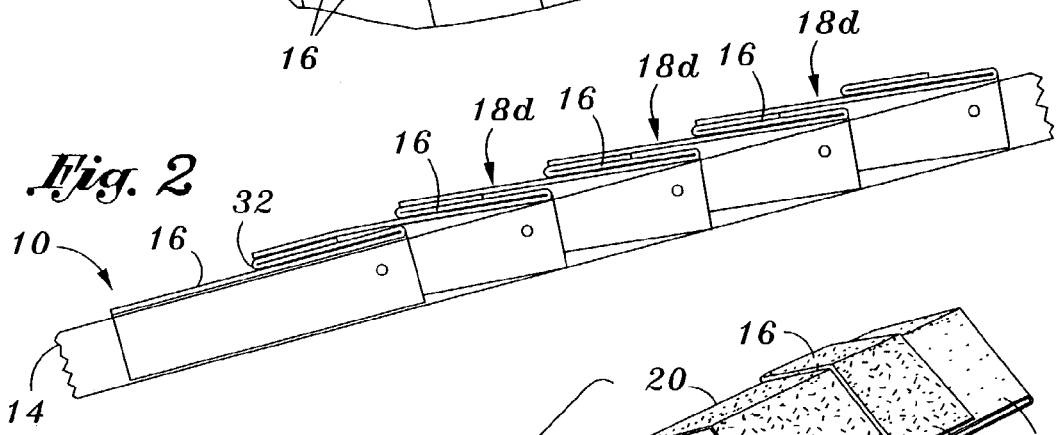
Figure 3:
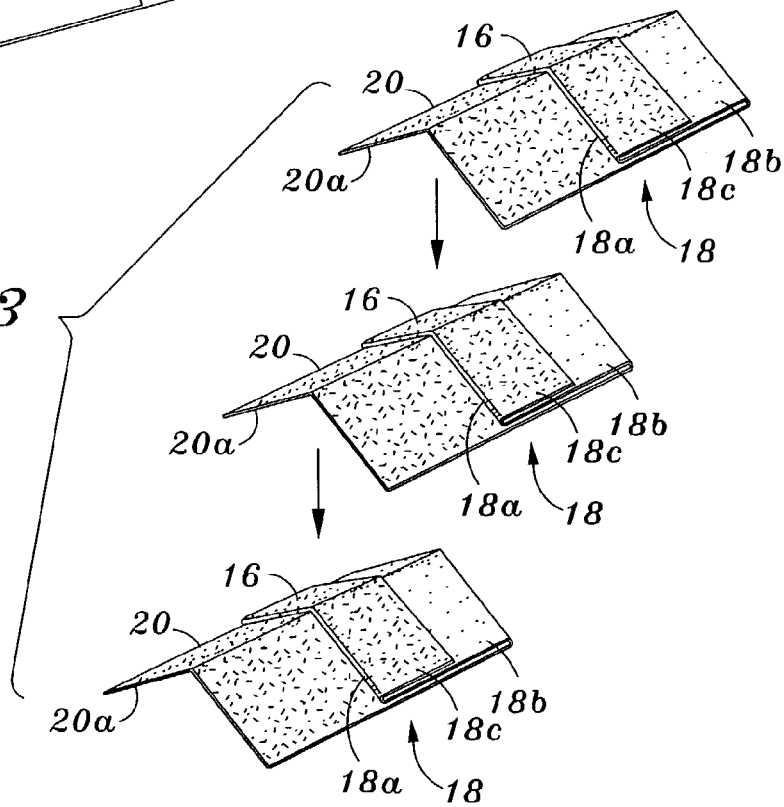
Figure 4:
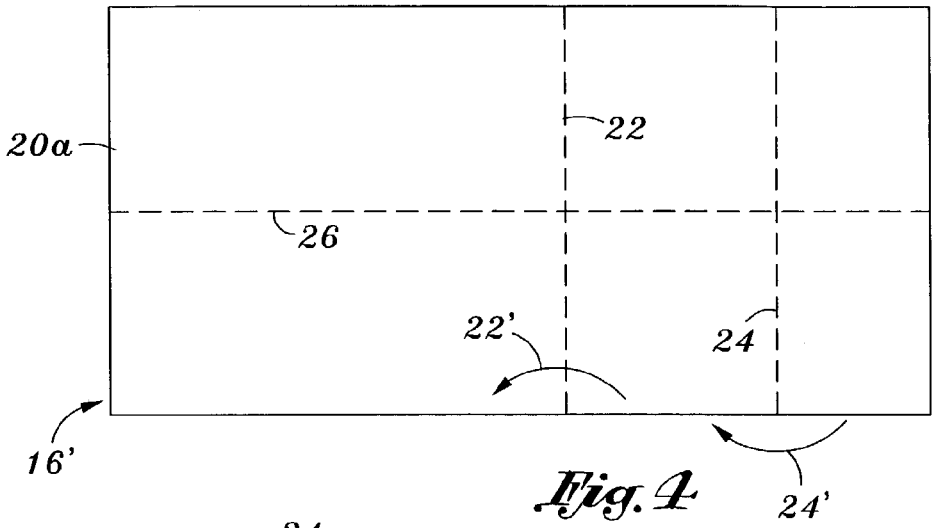
Figure 5:
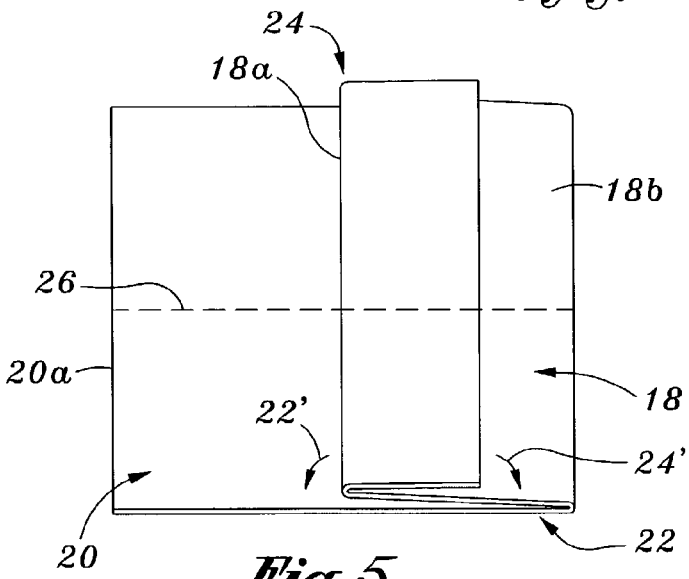
Figure 6:
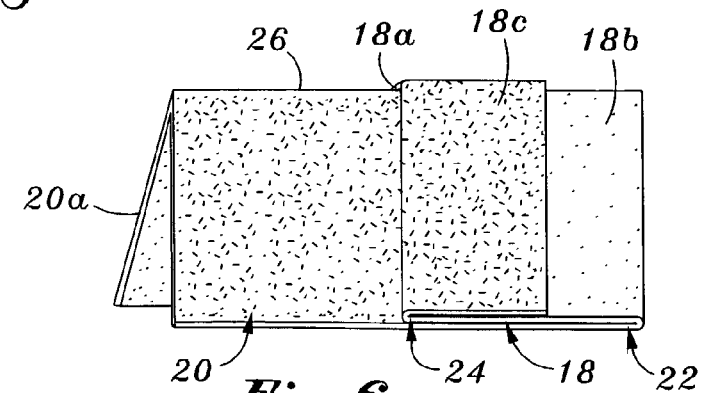
Figure 7:
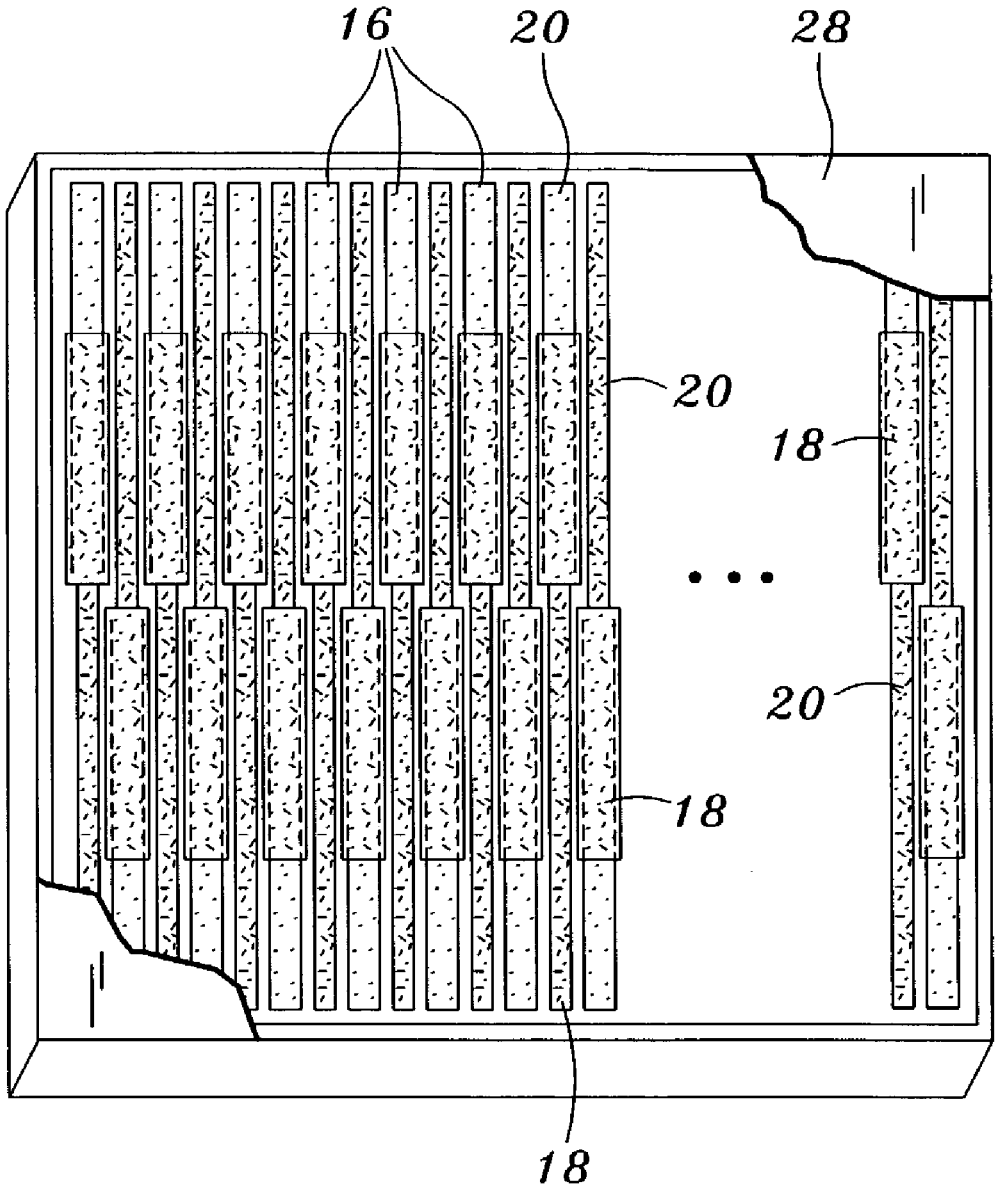

FIG. 1 provides a fragmentary perspective view of plural shingle ridge covers embodying the present invention installed along a rake of a roof;

FIG. 2 is a slightly enlarged fragmentary cross sectional view of the shingle ridge covers seen in FIG. 1, and showing the triple layer coverage provided by this ridge cover;

FIG. 3 provides an exploded perspective view of plural shingle ridge covers according to this invention, oriented relative to one another as they would be installed along a ridge, rake or hip of a roof;

FIG. 4 provides a plan view of a sheet of shingle material (i.e., a manufacturing intermediate article or work piece) at an intermediate stage of manufacture;

FIG. 5 shows the manufacturing work piece of FIG. 4, at a subsequent step of manufacturing in which the work piece is folded cross wise twice on itself in opposite directions (i.e., in which the work piece is back folded cross wise);

FIG. 6 provides another view of the manufacturing work piece at a still subsequent step of manufacture in which the work piece is folded lengthwise on itself; and FIG. 7 provides a view of a shipping box receiving plural shingle ridge covers according to the present invention, and illustrating how the plural shingle ridge covers nest together with each successive ridge cover being turned end for end relative to its adjacent ridge covers in the box so that the box is filled with substantially no ullage volume.

DESCRIPTION OF A PREFERRED EMBODIMENT OF THE INVENTION

Viewing the drawing Figures in conjunction with one another, and viewing first FIG. 1, a roof 10 is seen to include a pair of generally planar and conventional shingle-covered inclined surfaces or fields 12, which intersect with one another at an inclined hip 14. At the hip 14, the roof 10 includes a plurality of aligned and partially overlapping shingle ridge cover members 16 (hereinafter, referred to individually as a "shingle ridge cover"). The shingle ridge covers 16 have a chevron shape in end view, as is best seen in FIGS. 1 and 3. Those ordinarily skilled in the pertinent arts will appreciate that the same type of shingle ridge cover 16 employed at the hip 14 may be used also at the ridges and rakes (not shown) of the roof 10. Further, it is to be understood that the included angle at a ridge, hip, or rake will vary depending on the particular construction details and design of a particular roof. Thus, the included angle of the chevron shape of the ridge covers 16 will also vary as required for installation on the roof. The ridge covers 16 are sufficiently flexible to allow this variability in the chevron included angle, as will be more apparent in view of the following description.

As is more particularly shown in FIG. 2, the shingle ridge covers 16 each include a thickened (i.e., two or more layers of shingle material in thickness) chevron-shaped sheet-like upper portion 18 and a similar chevron-shaped sheet-like lower portion 20. Because the sheet of shingle material from which the ridge cover 16 is made is folded near its "upper" end (i.e., the end that will be an upper end when the shingle ridge cover is installed along a sloping hip or rake), this shingle ridge cover might be termed a "top folded" shingle ridge cover design.

The lower portion 20 terminates at a lower end edge 20*a*, and the portions 18 and 20 are delimited by a lower end edge 18*a* of the thickened upper portion 18. The edge 18*a* is defined by a thickest portion 18*c* of the shingle ridge cover 16, as will be further described. It is to be noted that the thickened upper portion 18 includes an upper marginal edge portion 18*b*, which upper marginal edge portion 18*b* provides a nailing margin. That is, as is seen at the upper right-hand portion of FIG. 1, the shingle ridge covers 16 may be secured to a roof by plural fasteners (nails or staples, for example) either penetrating the thickest portion 18*c*, or penetrating this nailing margin 18*b*, and entering the underlying roof structure.

In order to further provide understanding of the ridge cover 16, it is to be noted that the lower portion 20 is formed of a single thickness of shingle material. The upper portion 18 has a thickness of two layers of shingle material in the nailing margin 18*b*, and in a thickest central portion 18*c* extending between the edge 18*a* and nailing margin 18*b*, the shingle ridge cover 16 has a thickness of three layers of shingle material.

It will be understood that preferably, the shingle ridge cover 16 is installed on a roof by driving the roofing nails or other fasteners (staples, for example) through the thickest portion 18*c*. This mode of fastening the ridge covers 16 on a roof provides the most secure installation, and an installation that is particularly resistant to lifting of the ridge covers even in a very strong wind. On the other hand, where installation conditions permit, nailing the shingle ridge covers 16 through the nailing margin 18*b* has a particular advantage. However, it is to be noted that the shingle ridge cover 16 is not limited to being nailed at any particular place. That is, the invention is not limited by the place where an installer chooses to put nails or other fasteners, such as roofing staples, through the shingle ridge covers 16.

As is seen in FIG. 3, the shingle ridge covers 16 are installed on the roof 10 with the lower edge 20*a* of portion 20 aligning with and overlying the edge 18*a* of the upper portion 18 (as is indicated by the arrows on FIG. 3). The centrally-located thickest portion 18*c* provides for the overlying portion 20 of a next-successive shingle ridge cover to be spaced away from (i.e., above) the nailing margin 18*b* by a space 18*d*, arrowed on FIG. 2. This space 18*d* is substantially equal to the thickness of the shingle material from which the ridge cover 16 is made, and is consequently much greater than the thickness of the nail heads or staple cross bars of the roofing nails or staples used to secure the shingle ridge covers. Those ordinarily skilled will understand that the roofing nails or staples are ordinarily driven flush. But, even if not driven flush, the nail heads or staples do not adversely affect the next successive shingle ridge cover, as will be further explained.

Further, as FIG. 2 illustrates, the roof 10 is provided everywhere along the rake 14 (or along a ridge or hip) with at least three layers of shingle material. That is, two or three layers of shingle material are provided in the portion 18 of the shingle ridge cover 16, and in the portion 20 which overlies the portion 18, an additional single layer of shingle material is provided. Those ordinarily skilled in the pertinent arts will recognize that a dollop or two of adhesive material may be provided on the portion 18*c*, to secure to the underside of portion 20 of a next-successive shingle ridge cover as installed, in order to resist any tendency for the shingle ridge covers to lift in a strong wind.

Turning now to FIG. 4 a shingle ridge cover work piece 16' is seen at an intermediate stage of manufacture. This shingle ridge cover work piece 16 is a sheet like piece of shingle material (i.e., perhaps cut from a larger piece of shingle material) and the work piece 16' is shown in FIG. 4 with the granule coated surface upward in this Figure. That is, the surface of the work piece that will become the upper surface of the finished shingle ridge cover is also seen upward in this Figure. It is to be further understood that the work piece 16' is a manufacturing intermediate article, which will become a shingle ridge cover upon the completion of manufacturing steps yet to be carried out. For purposes of illustration and explanation, on FIG. 4, dashed lines are shown at the location of folds yet to be made in the work piece 16'. These dashed lines do not actually exist on the work piece 16' and are for purposes of illustration only in the present drawings. Also, these dashed lines do not represent slits, cuts, or score lines on the work piece 16'. Rather, the work piece 16' is free of all slits, cuts, and score lines, so that there is no pre-established tendency for the work piece to fold at any particular location, and there is also no pre-established tendency for the work piece to fracture, fissure, or tear at any particular location.

However, as is illustrated by the dashed lines at 22 and 24 of FIG. 4, corresponding oppositely directed cross folds (also indicated with numerals 22 and 24—with the direction of folding being indicated by arcuate arrows and the numerals 22' and 24') are placed in the ridge cover work piece 16'. These folds may be made in numerical sequence, although such is not required. The result of this folding operation is the work piece seen in FIG. 5. In FIG. 5, the dashed line 26 indicates the location of a single lengthwise fold (also indicated with numeral 26) which results in the work piece becoming a finished shingle ridge cover, as is indicated in FIG. 6, and having a chevron shape in end view. However, it is to be noted that during manufacturing of the shingle ridge covers 16, the fold 26 is not limited or stopped at a chevron shape for the shingle ridge cover. That is, the fold 26 is carried to a full 180 degrees, so that the shingle ridge cover 16 is fully folded lengthwise on itself.

To recap, the present inventive shingle ridge cover 16 is formed from a generally rectangular work piece 16' of sheet shingle material which is free of cuts, slits, and score lines. This work piece may be, for example, fiberglass mat or felt with impregnating asphaltic material modified to make it pliable, and covered on an upper face with adhered colored protective mineral granules. The shingle ridge cover 16 is made from this work piece 16' by being folded on itself at one end, and is backfolded on itself intermediate of its length to provide a centrally-located thickened portion 18 intermediate of the length of the shingle ridge cover. Adjacent to the one folded end (fold 22), the shingle ridge cover 16 provides a nailing margin 18*b* that is thinner than the centrally-located thickest portion 18*c* of the shingle ridge cover. Consequently, the adjacent centrally-located thickest portion 18*c* of the shingle ridge cover provides protection and space for the roofing nails or other fasteners used to secure the shingle ridge cover to a roof structure, if these fasteners are driven through the nailing margin 18*b*. That is, a shingle ridge cover 16 may be installed by use of fasteners which penetrate this nailing margin and engage into the underlying roof structure. A next successive shingle ridge cover overlays the nailing margin an is somewhat spaced vertically (i.e., above) this nailing margin by the central thickened portion of the shingle ridge cover. Thus, a space 18*d* (arrowed in FIG. 2) is created above the nailing margin and below the overlying shingle ridge cover in which the fasteners may "work" or elevate slightly due to shifting, moisture variations, and expansion/contraction of the roof structure with changing temperatures. Consequently, fasteners that are not driven flush to begin with, or fasteners that become slightly lifted with the passage of time do not press adversely against the underside of an overlying shingle ridge cover, and do not adversely affect the life of the shingle ridge covers. Further to the above, it should be noted that the present inventive shingle ridge cover is not limited to being nailed through the nailing margin 18*b*. That is, especially in areas of the country where high winds are experienced, and where concerns about roofing materials such as shingles and ridge covers being lifted by the high winds are especially present, the shingle ridge covers 16 may be nailed through the thickest portion 18*c*. This location of nailing in portion 18*c* results in there being a shorter distance from the nails to the edge 18*a* and an improved resistance to lifting of the shingle ridge cover in high winds.

Continuing with a consideration of the drawing Figures, as is seen in FIG. 7, the reason for the fold 26 being carried to a full 180 degrees (i.e., the shingle ridge cover being fully folded lengthwise on itself) is to allow the shingle ridge covers 16 to better pack into a shipping box 28 for plural shingle ridge covers. Further considering FIG. 7, it is seen that plural shingle ridge covers 16 are packed for shipping into a rectangular shipping box, with each successive shingle ridge cover 16 being turned end-for-end relative to the preceding shingle ridge cover 16 in the box 28. That is, adjacent shingle ridge covers 16 in the box 28 are turned oppositely and nest together so that the end portions 18 and 20 of adjacent shingle ridge covers are adjacent to one another. It is to be noted that because the portion 18 when folded on itself presents six layers of shingle material, and the portion 20 when so folded presents only two layers of shingle material, that two adjacent ridge covers turned end for end have a thickness at each end totaling eight layers of shingle material. Also, the length of the portion 18 is substantially one half of the total length of the finished shingle ridge cover, so that the shingle ridge covers also nest together in this respect within the box 28. The total result is that the plural shingle ridge covers 16 packed into the box 28 substantially fill this shipping box with substantially no ullage volume. Accordingly, shipping costs and shipping volume for the packed shingle ridge covers is reduced.

On the roof 10 successive shingle ridge covers are installed either along a ridge 14, or are installed upwardly along a hip or rake 14, by individually removing the shingle ridge covers from their shipping box, opening the fold 26 to match the included angle on the hip, ridge, or rake, and nailing the ridge cover either through the thickest portion 18*c*, or through the nailing margin 18*b*, as is shown in FIG. 1. As thus nailed to the roof 10, if the nails are placed through the nailing margin 18*b*, then the exposed nail heads 30 on one shingle ridge cover are covered by the next successive shingle ridge cover 16. Because the nailing margin 18*b* has a thickness of two layers of the shingle material, while the adjacent portion 18*c* has a thickness of three layers of the shingle material, the nail heads 30 are spaced below the overlying and next-successive shingle ridge cover. Further, this difference in thickness between the portions 18*b* and 18*c* provides a margin of safety for nail "pop up" so that a nail can pop up or lift somewhat without the nail head pressing hard against the underside of the overlying shingle ridge cover. This is an important aspect of the shingle ridge cover 16 because expansion and contractions of the roof structure 10 with changing humidity, dampness, and temperature conditions can result in shingle nails 30 tending to lift somewhat or to "pop up" somewhat. With conventional ridge covers which make no allowance for this nail lifting phenomenon, the lifted nail heads can press hard against the underside of an overlying ridge cover. In extreme cases, the lifted nail head actually pushes though or tears partially or fully through an overlying ridge cover. Regardless of whether a lifted nail head pushes only partially or even fully through a conventional ridge cover, this effect is adverse to the protection provided to the roof structure by conventional ridge covers, and can shorten the life of the roof. Since this phenomenon of lifting of shingle nails is provided for and can take place with no adverse effect on the shingle ridge covers 16, a more durable and long lived roof covering results.

Further, each ridge cover 16 is installed with the lower portion 20 of each overlapping the upper portion 18 of the preceding ridge cover member to cover the nail heads exposed on this preceding cover member, and so that the end edge 20*a* falls just at the edge 18*a*. Alternatively, a lower end edge 18*a* of each successive ridge cover member 16 may extend just slightly down-slope beyond the edge 18*a* of the preceding shingle ridge cover 16. Consequently, as the ridge covers 16 are installed on roof 10, they provide a shadow, referenced on the drawing Figures with the numeral 32, falling on the lower portion 20 of the next lower shingle ridge cover. Those ordinarily skilled in the pertinent arts will recognize that the existence and extent of the shadow 32 depends on the ambient lighting conditions, and that this shadow generally will be similar aesthetically to that at a hip, ridge, or rake of a wood shake roof.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. For example, the shingle ridge cover 16 of the present invention does not need to be manufactured with the central lengthwise fold 26. The resulting ridge cover would be substantially flat, as is seen in FIG. 5, and would pack into a shipping box by alternating successive shingle ridge covers end-for-end, much as the preferred embodiment packs into a shipping box. The flat version of this inventive shingle ridge cover would be folded lengthwise by the roofer during installation. However, the presently depicted and described embodiment is preferred because having the lengthwise fold 26 formed at the factory during manufacture of the ridge covers insures uniformity and repeatability of the location of this fold. This fold provides an installation guide for the roofer by which the shingle ridge covers are aligned along a ridge, hip, or rake of a roof. On the other hand, if a roofer makes this fold in the field during a roof installation, the uniformity of placement of the fold and of the shingle ridge covers on a roof may not be as good. Nevertheless, it is to be noted that a flat version of this inventive shingle ridge cover is within the ambit of this invention. Accordingly, the depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A plurality of shingle ridge covers, each shingle ridge cover comprising: a generally rectangular work piece of sheet shingle material having an upper granular face and a length dimension, said work piece being folded on itself at a fold line extending perpendicular to said length dimension to define an upper end of the shingle ridge cover, a folded length of the ridge cover, and an upper and lower portion of the ridge cover with said upper granular face of said upper and lower portions confronting one another, and said upper portion of said work piece further being backfolded on itself intermediate of the folded length of the shingle ridge cover to provide a third portion overlying said upper portion and having its upper granular face oriented upwardly the same as said lower portion; said lower portion, said upper portion and said third portion overlying one another to cooperatively define a centrally-located triple-thick portion for said ridge cover, which triple-thick portion is located intermediate of the length of the shingle ridge cover, said folded shingle ridge cover providing a nailing margin extending between said upper end and said triple-thick portion, said nailing margin being thinner than the centrally-located triple-thick portion of the shingle ridge cover, whereby said centrally-located triple-thick portion of said shingle ridge cover is cooperable with a next-successive ridge cover installed on a roof to space this next-successive shingle ridge cover above and slightly away from said nailing margin to thereby provide protection and head space for fasteners securing the shingle ridge cover to a roof structure.

2. The shingle ridge cover of claim 1, in which said work piece is substantially free of cuts, slits, and score lines.

3. A plurality of shingle ridge covers for roofing, each shingle ridge cover comprising;

a generally rectangular work piece of sheet shingle material;

said work piece being folded cross wise on itself intermediate of the length of the work piece to define one end of the shingle ridge cover, and said work piece being back-folded on itself intermediate of the folded length of the shingle ridge cover to provide a centrally-located thickest portion for the shingle ridge cover intermediate of the length of the shingle ridge cover at which said shingle ridge cover has a thickness substantially equal to three thicknesses of said work piece;

said folded shingle ridge cover providing a nailing margin adjacent to the one folded end and said nailing margin having a thickness substantially equal to two thicknesses of said work piece;

whereby said centrally-located thickest portion of said shingle ridge cover is co-operable with a next-successive ridge cover installed on the roof to space an overlying portion of this next-successive shingle ridge cover away from said nailing margin to thereby provide protection and space for fasteners used to secure the shingle ridge cover to the roof structure.

4. The shingle ridge cover of claim 3, in which said work piece is substantially free of cuts, slits, and score lines.

5. A plurality of shingle ridge covers for roofing, each shingle ridge cover comprising: a generally rectangular work piece of sheet shingle material having a thickness; said work piece being back-folded on itself intermediate of its length to provide said shingle ridge cover with a centrally-located thickest portion defined by three stacked portions of said work piece overlying one another, said centrally-loctaed thickest portion of said ridge cover cooperating with a shingle ridge cover end portion of shingle thickness to provide a step at which the thickness of the shingle ridge cover changes from single thickness to three thickness of said work piece; and adjacent to an end of said shingle ridge cover opposite to said one end portion said shingle ridge cover providing a nailing margin which has a thickness of two layers of said work piece;

wherein said centrally-located thickest portion of said shingle ridge cover is co-operable with said nailing margin to space away a next-successive shingle ridge cover installed on a roof, and thus to prevent next-successive shingle ridge cover from touching fasteners securing said shingle ridge cover to said roof.

6. A cooperative pair of shingle ridge covers for roofing; each of said shingle ridge covers being substantially identical to one another, and each one of said pair of shingle ridge covers comprising:

a generally rectangular work piece of sheet shingle material having a thickness, an upper granular covered face and a length dimension, said work piece being folded on itself at a fold line perpendicular to said length dimension to define an upper end of the shingle ridge cover and a folded length for the single ridge cover, said fold at said upper end of said ridge cover separating an upper portion and an underlying lower portion with said upper and lower portions having their granular covered faces confronting one another, and said work piece also being backfolded on itself in said upper portion and intermediate of the folded length of the shingle ridge cover to provide a centrally-located thickest portion of triple-thickness intermediate of the length of the shingle ridge cover, and said ridge cover lower portion being of single thickness so that said centrally-located thickest portion cooperates with said lower portion to provide an upwardly directed step intermediate along the length of said shingle ridge cover;

adjacent to said folded upper end of said shingle ridge cover a nailing margin of double thickness being provided which is thinner than said centrally-located thickest portion, and which extends from said upper end to said centrally-located thickest portion of the shingle ridge cover;

whereby a first of said pair of shingle ridge covers is installed on a roof by fasteners penetrating through said nailing margin and engaging into said roof; and the second of said pair of shingle ridge covers is installed on said roof by aligning a lower end edge of said lower portion with said step of said first shingle ridge cover, while said centrally-located thickest portion of the first ridge cover spaces the second shingle ridge cover above said nailing margin of the first ridge cover; and said second ridge cover is also secured to said roof by fasteners located in said nailing margin and is spaced from the fasteners securing the first shingle ridge cover to the roof.

7. The cooperative pair of shingle ridge covers of claim 6 wherein said pair of shingle ridge coves also cooperate to define a visually apparent step in thickness of the cooperating pair of shingle ridge covers, said apparent step in thickness being located substantially at said step of said first shingle ridge cover, and to which is added the thickness of said lower portion of said second shingle ridge cover which overlies said centrally-located thickest portion of the first shingle ridge cover of said pair.

8. A method of providing a system of plural shingle ridge covers for roofing, for each of said plural shingle ridge covers said method comprising steps of:

providing a substantially rectangular work piece of shingle roofing material, said work piece having a length dimension and a width dimension, said work piece further having an upper side coated with protective granular material, and an underside;

forming a first fold in said work piece cross wise thereof and intermediate of the length of the work piece to define at said first fold an upper end of the shingle ridge cover, and to overlap upon a first portion of the work piece a second portion so that the upper side faces of each of said first and second portion confront one another; and so that the underside of said second portion is upward;

forming a backfold in said work piece at an edge of said second portion and intermediate of the length of the shingle ridge cover so that a third portion of said work piece is folded on top of said second portion and the underside of said second portion confronts the underside of said third portion, and the upper side of said third portion is upward, and so that said second portion and third portion in cooperation provide a centrally-located thickest portion for the shingle ridge cover intermediate of the length of the shingle ridge cover; said thickest portion being disposed at one edge thereof substantially at a mid-length location of the folded shingle ridge cover, and said third portion extending from said mid-length location toward but short of said folded upper end of said shingle ridge cover, so as to expose a portion of the second portion as a nailing margin for said shingle ridge cover; and providing for said centrally-located thickest portion of said shingle ridge cover to be cooperable with a next-successive ridge cover installed on a roof in order to space an overlying portion of this next-successive shingle ridge cover away from said nailing margin of the shingle ridge cover.

9. The method of claim 8 further including the steps of: utilizing said centrally-located thickest portion of said shingle ridge cover to cooperate with a lower portion defined by an exposed part of said first portion extending from said mid-length location to a lower edge of the shingle ridge cover so as to define a centrally located upwardly directed step in thickness of said shingle ridge cover.

10. The method of claim 9 further including the steps of utilizing said centrally located upwardly directed step in thickness of said shingle ridge cover to cooperate with a lower end edge of a next-successive ridge cover on a roof so as to create a shadow line on the roof.

11. A method of forming from a substantially rectangular work piece of sheet shingle material a shingle ridge cover, said method comprising steps of:

folding said generally rectangular work piece of sheet shingle material crosswise of its length to define an upper end of the shingle ridge cover, and to provide a lower portion of the shingle ridge cover, and a second upper portion of the shingle ridge cover;

folding said second portion of the shingle ridge cover back on itself substantially at the middle of the length of the shingle ridge cover to provide a centrally-located thickest portion of the shingle ridge cover which is of triple-thickness extending from substantially the middle of the length of the shingle ridge cover toward but short of said upper end, providing for an exposed part of said second portion above said thickest portion of said shingle ridge cover to define a nailing margin adjacent to the one folded end, and which nailing margin is of thickness less than said centrally-located thickest portion and which is of double-thickness of said sheet shingle material.

12. A top folded shingle ridge cover comprising:

a generally rectangular work piece of sheet shingle material having a granular covered upper face, a length dimension and a thickness dimension and which is folded back on itself once at a line perpendicular to said length dimension to define an upper thickened portion of the shingle ridge cover, a folded length for the ridge cover, and to also define an upper end termination for the shingle ridge cover; and said shingle ridge cover being backfolded on itself again and also at a line perpendicular to said length dimension within said upper thickened portion and intermediate of the folded length of the shingle ridge cover to provide a centrally-located thickest portion of triple-thickness having one edge intermediate of the length of the shingle ridge cover and a second edge disposed toward but spaced from said upper end termination of said shingle ridge cover;

said second edge of said centrally located thickest portion being spaced from said upper end termination of said ridge cover to provide therebetween a nailing margin of double thickness.

13. The shingle ridge cover of claim 12, in which said work piece is substantially free of cuts, slits, and score lines.

* * * * *